United States Patent [19]

Yahrmarkt et al.

[11] 4,388,148

[45] Jun. 14, 1983

[54] PROCESS FOR PRODUCING PULP

[75] Inventors: Richard A. Yahrmarkt, Batavia, Ill.; Michael J. Stanbrough, Benicia, Calif.

[73] Assignee: Nalco Chemical Company, Oak Brook, Ill.

[21] Appl. No.: 276,714

[22] Filed: Jun. 23, 1981

[51] Int. Cl.[3] ..... D21B 1/16

[52] U.S. Cl. ..... 162/26; 162/28; 162/79

[58] Field of Search ..... 162/26, 28, 71, 79

[56] References Cited

U.S. PATENT DOCUMENTS

| | | | |
|---|---|---|---|
| 2,601,110 | 6/1952 | Fisher et al. | 162/79 |
| 2,947,655 | 8/1960 | Eberhardt | 142/26 |
| 3,808,090 | 4/1974 | Logan | 162/28 |

FOREIGN PATENT DOCUMENTS

| | | | |
|---|---|---|---|
| 565955 | 11/1958 | Canada | 162/71 |

OTHER PUBLICATIONS

Pulp & Paper, pp. 177–179, Mar. 1978.

ABIPC, vol. 49, No. 1, Jul. 1978, Abstract 370.

*Primary Examiner*—William F. Smith

*Attorney, Agent, or Firm*—Joan I. Norek; John G. Premo; Robert A. Miller

[57] ABSTRACT

The present invention provides a process for producing pulp which includes the step of adding alkaline salt of aluminate to pulp material to reduce energy consumption in the mechanical treatment of the pulp material, and alkaline salt of aluminate for use in such a process and pulp as produced by such a process. In preferred embodiments, the present invention provides such a process for producing pulp at a wet pulp material maximum pH of about 8.5, and a process that includes the step of adding at least one pound of alkaline salt of aluminate per dry ton of end product pulp, and a process where the mechanical treatment is a mechanical refining process, particulary mechanical treatments that are at least a part of treatments known generally as refiner mechanical pulping and thermo mechanical pulping, and alkaline salt of aluminate for use in such processes and pulp as produced by such processes.

9 Claims, No Drawings

PROCESS FOR PRODUCING PULP

TECHNICAL FIELD OF THE INVENTION

The present invention is in the technical field of processes for producing pulp, generally known as pulping processes, particularly those pulping processes that are at least partially mechanical treatments of pulp material to produce pulp. More particularly, the present invention is in the technical field of reduction of energy consumption in the pulping process.

BACKGROUND OF THE INVENTION

Pulp is the raw material used to manufacture paper and paper products. It is produced by the mechanical and/or chemical treatment of plant substances that contain cellulose. Such treatments generally eliminate at least a portion of the non-cellulose constituents of such plant substances, break up the plant substances into fiber bundles or smaller fiber entities, and generally to some extent hydrate the plant substance. These treatments are generally known as pulping processes, i.e., processes for producing pulp.

Chemical treatments of plant substances to produce pulp generally act by eliminating constituents such as lignin that hold plant substance fibers together, disintegrating the substance into its component fibers. Mechanical treatments rely mainly on friction to separate fibers or fiber bundles.

Pulping can be achieved through essentially all chemical treatment (chemical pulping), through essentially all mechanical treatment (mechanical pulping), or through a combination of chemical and mechanical treatments (semichemical pulping). Thus mechanical treatments are used in both mechanical pulping and semichemical pulping.

In mechanical treatments, energy consumption is one of the most important production factors, and can well be the most important problem. Reduction in energy consumption, without a concomitant reduction in pulp quality, is greatly desired in the pulping field.

Pulp quality is generally measured by pulp strength (bursting strength of the paper products manufactured therefrom) and pulp freeness (readiness with which water drains freely from pulp material). The higher the pulp strength and the lower the pulp freeness, the higher the pulp quality.

Pulp strength of pulp produced at least partially by mechanical treatment is believed directly related to, and directly proportional to, the energy consumed in such mechanical treatment. Pulp freeness is also believed directly related to, and inversely proportional to, the energy consumed in the mechanical treatment.

Reducing energy consumption in mechanical treatment of pulp material without reducing the resultant pulp strength of reducing the decrease in pulp freeness associated with the pulping process, while maintaining the same level of production of pulp, is highly desirable. The level of energy consumption per unit time could be kept as high as normal, increasing the mill throughput, i.e., the pulp produced per unit time, and thus reducing the energy consumed per unit pulp production. In multiple mechanical refiner operations, the number of refiners utilized for a given day's production could be reduced, or the refiners could be operated for shorter periods of time each day. The end result in any case would be a savings in energy cost and a conservation of energy resources.

Such a reduction of energy consumption by the use of an additive whose use cost is small in proportion to the cost of the energy saved is also extremely desirable for pulp mills.

DISCLOSURE OF THE INVENTION

The present invention is a process for producing pulp which includes the step of adding alkaline salt of aluminate to pulp material in sufficient quantity to reduce energy consumption in the mechanical treatment of the pulp material, and alkaline salt of aluminate for use in such a process and pulp as produced by such a process.

By mechanical treatment of pulp material is herein meant the application of friction to pulp material to produce pulp, whether that treatment is part of a totally mechanical pulping process or is part of a semichemical pulping, and whether that mechanical treatment is consider in the pulping field as a refining process or otherwise. By pulp material is herein meant plant substances that are being treated, or are to be treated, to produce an end product pulp, such as pulp stock that already has been subjected to some form of digestion, or untreated plant substance, such as wood logs or wood chips.

In preferred embodiments, the present invention is a process for producing pulp at a wet pulp material maximum pH of 8.5, and a process that includes the step of adding at least one pound of alkaline salt of aluminate per dry ton of end product pulp, and a process where the mechanical treatment is a mechanical refining process, particularly mechanical treatments that are at least a part of treatments known generally as refiner mechanical pulping and thermo mechanical pulping, and alkaline salt of aluminate for use in such processes and pulp as produced by such processes. (All levels of alkaline salt of aluminate specified herein are based on weight of the salt itself.)

BEST MODE FOR CARRYING OUT THE INVENTION

The production of pulp (pulping) by totally mechanical treatment is a method that relies mainly on friction to break the plant substance, usually wood, into fiber bundles or smaller fiber entities. In such pulping, there is little elimination of lignin or other fiber-binding substances (which elimination is a major characteristic of chemical pulping). A pulp produced by such a total mechanical method is generally known as a "groundwood" pulp, although the term is also used to designate pulps produced by semichemical pulping, which is described more fully below.

Mechanical pulping can involve the wet grinding of wood, such as wood logs, into a fibrous mass by means of a revolving grindstone. The wood is forced against the stone and friction tears fibers or fiber bundles away from the wood. The resultant pulp stock generally must be screened to remove coarse splinters and unground wood prior to using the pulp in paper manufacture. Sucn undesirable material can also be removed by other methods, such as by centrifugal cleaners, or combinations of methods.

Mechanical pulping by grinding is also a refining process, the extent of refining being determined at least partially by the smoothness of the grindstone. The fibers or fiber bundles torn away from the wood continue to be subjected to friction, resulting in a decrease of pulp material freeness as this pulping process continues.

Mechanical pulping can also involve both the use of grinders and refiners, such as disc mills. Disc mills or disc refiners can be used to refine further that portion of the pulp material that is too coarse for the intended use. In some instances, the coarse portion of the material after grinding is separated, treated in a disc refiner, and then added back to the main pulp stock. In other instances, the pulp material can be deliberately ground to a suitable coarseness, and the entire pulp material, minus any splinters or unground wood, can be treated in a disc refiner.

In semichemical pulping, the plant substance is treated with chemicals before or during mechanical treatment, usually to improve pulp strength and fiber length. Logs for instance can be chemically treated prior to grinding or during grinding, although the latter is not common.

One of the primary purposes of such chemical pretreatment is to loosen the plant substance fiber structure, permitting it to be defibrated at a lower energy consumption. Penetration of the chemicals into the fiber structure thus is a primary factor in the effectiveness of the chemical treatment, and it is very common to use wood chips, rather than logs, as the starting plant substance material.

Using a digester, wood chips are commonly "cooked" in a chemical cooking liquor at elevated temperature and pressure conditions prior to transfer to a refiner, such as a disc refiner, for mechanical treatment.

Refining can be carried out in a single stage or in several stages. For instance, the pulp material can be passed through a single refiner, or primary and secondary, or further, refiners can be used, the pulp material passing through one of each category. In the latter type progressive multi-stage refining processes, the disc refiners generally have progressively more teeth per square foot as the refining progresses.

Refining with the use of disc refiners is generally classified further by whether the disc refiners are pressurized or not. Refining with non-pressurized refiners is generally known as "refiner mechanical pulping". Refining with pressurized refiners (usually at about 30 psi) is generally known as "thermo mechanical pulping".

As mentioned above, the quality of pulp is generally measured by bursting strength and freeness. As the pulping continues, freeness decreases and bursting strength increases, and this requires the continued consumption of energy applied to the pulp material during pulping.

A commonly used, and highly accurate, method of determining pulp freeness is the Canadian Standard Freeness Test, which is performed with equipment machined to standard dimensions. The method involves pouring one liter of pulp material diluted to a consistency of $0.3\pm0.02$ percent into a cylinder closed at the bottom with a wire gauze and then a hinged base. The cylinder is then closed at the top except for a small top tap, and then opened at the bottom, allowing water to flow through the wire gauze into a spreader cone below. This spreader cone has a side tube through which a certain amount of the water passes into a graduated cylinder. Its volume, in milliliters, is the measure of freeness. As the quality of pulp increases, the pulp material releases less water during this test, resulting in a lower measure of freeness.

The pulp material temperature during the Canadian Standard Freeness Test should be $20°\pm0.1°$ C., and if it is not, the freeness should be corrected to this temperature. Consistency (weight percent pulp solids to the total material mass) should be as specified or an appropriate correction applied.

Wood variables, such as wood species, density, moisture content, and such, all effect grinding and refining characteristics and the quality of the pulp produced. For instance, for a given bursting strength, different species will vary as to freeness required to achieve the bursting strength, and the energy consumed for a unit pulp production.

The presence of alkaline salt of aluminate during the mechanical treatment of pulp material has surprisingly been found to reduce energy consumption required to produce pulp of a given quality. By alkaline salt of aluminate is herein meant the various alkaline salts of aluminate, such as sodium aluminate, $Na_2Al_2O_4$, potassium aluminate, $K_2Al_2O_4$, and the like, and mixtures of such aluminate salts, generally introduced to the process in aqueous solution.

In a continuous pulping process, such reduction in energy consumption can be initially detected by a decrease in recorded refiner amperage load with generally a concomitant drop in pulp output freeness. (Normally outside of the present invention a decrease in refiner amperage load is accompanied by an increase in pulp output freeness, less energy being applied, resulting in pulp of less quality.) Energy consumption reduction can be determined more directly from watt-hour meter readings, where available. The ultimate measure of course is that of energy consumption per unit of dry pulp production of a given quality.

It has been found that the addition of alkaline salt of aluminate at a level of one pound of salt per dry ton of end product pulp results in a detectable drop in energy consumption during the mechanical treatment of the pulping process. It is believed that energy consumption continues to decrease with increasing levels of alkaline salt of aluminate until and upper energy consumption reduction is reached at about an addition level of six to seven pounds of alkaline salt of aluminate per dry ton of pulp production.

Alkaline salts of aluminate, such as sodium aluminate, are often supplied as aqueous solutions with stabilizer additive, such as sorbitol or gluconates. Such aqueous solutions, for instance at a 50 percent by weight aluminate salt concentration, are suitable for use in the present invention and can be added at such concentrations for instance by spraying it directly on the pulp material while it is being charged to the refiner. As an alternative, a 50 percent aluminate salt solution could be diluted, for instance 2, 5, or 10 fold, and thus sprayed onto the pulp. Thus aqueous solutions of from about 0.05 to about 50 percent by weight salt are considered extremely useful for introduction of the salt to the pulping processes of the present invention. Another alternative method of charging the aluminate salt to a refiner would be to admix it, or a concentrated solution of the salt, with the dilution water that is charged to the refiner to adjust the consistency of the pulp material during refining (which dilution water is sometimes referred to as the dilution water charged to the "refiner eye"). (Pulp material is generally diluted to a consistency of about 20 percent to about 30 percent for refiner mechanical pulping and somewhat higher consistencies for thermo mechanical pulping.)

As pulp material components are solubilized during pulping, they are at least partially lost as liquid is removed, decreasing the pulp yield and thus the production of pulp. The present invention is extremely effective at a wet pulp material pH of about 7.5, and holding this wet pulp material pH to a maximum of about 8.5 is believed important in avoiding unnecessary solubilization of pulp components, and is a preferred embodiment of the invention. (Wet pulp material pH's in the range of about 10 and higher have been known to significantly reduce yield and cause paper produced therefrom to be less opaque than desired.)

Since there are wide variations in the mechanical treatments to which pulp material can be subjected in different pulping mills, wide variations in the plant substance used, and wide variations in the chemical pretreatments applied, no universal correlation can be made between the level of alkaline salt of aluminate added and a precise energy consumption reduction. Moreover, for different end uses, different pulp qualities are sought, and thus the energy applied normally differs.

A level of one pound of alkaline salt of aluminate per dry ton of pulp production is believed, however, a minimum additive level to see a noticeable reduction in energy consumption, while a level of seven pounds, same basis, is believed the point at which increasing additive level is not justified by the further drop in energy consumption. Additive levels of from about two to about six pounds, same basis, is preferred, and levels of from about three to about five pounds, same basis, is even more preferred.

It may also be desirable to include in an aqueous solution of the alkaline salt of aluminate, in addition to stabilizer additives mentioned above, other additives, such as surface active agents to prevent resin migration and hence prevent equipment fouling, or additives to prevent brightness loss, or other additives believed desirable in the pulping and paper making processes. The process, additive, and end product pulp of the present invention include the use of aqueous solution of alkaline salt of aluminate plus other additives as desired.

The utility and effectiveness of the present invention are further illustrated by the following examples.

EXAMPLE I

In a pulp mill having a target of refining to a Canadian Standard Freeness of 250 to 300, measured at 0.3±0.02 percent consistency using recylcled water for dilution of pulp stock output, wood chips were impregnated for five minutes in a rapid cycle digester with neutral sulphite liquour. The final processing was done by a continuous system having three primary refiners followed by four secondary refiners. (All refiners were non-pressurized 1,000 HP Bauer model 411 double disc refiners that can draw 200 amps power each.)

The wood chips, after digestion, were squeezed in a screw presser and discharged into a screw conveyor at a consistency of about 45 to about 50 percent. When an aluminate salt was used, a 50 weight percent aqueous solution of sodium aluminate was sprayed directly onto the pulp material in that screw conveyor that feeds into the primary refiners.

Each of the primary refiners discharged the initially refined pulp material into a common trough from which the pulp material was fed into one of the four secondary refiners.

The energy consumed in pulping about 40 to 50 bone dry tons of pulp per day to the target freeness was determined with and without the addition of sodium aluminate. No significant loss of pulp quality was observed in the pulp produced with the sodium aluminate additive. The energy consumption is shown below in Table 1.

TABLE 1

| Level of sodium aluminate additive | Energy consumed per dry ton pulp production |
|---|---|
| none | 2,039 kilowatt-hours* |
| 5 lb. per ton pulp | 1,828 kilowatt-hours** |

*Average over a seven day control period.
**Average over a thirteen day test period.

The above test data demonstrates a 10.3 percent reduction in energy consumption with a preferred level of alkaline salt of aluminate addition.

EXAMPLE II

For the same mill and refiners described above in Example I, pulping was monitored prior to sodium aluminate addition and during that addition. Again, a 50 percent solution of additive was sprayed directly on the pulp material just prior to its feeding to the primary refiners.

A comparison of pulping with and without sodium aluminate addition is shown below in Table 2, wherein Time A is prior to sodium aluminate addition and Time B is during that addition. For each time, the current being drawn by each refiner, the refining consistency, and the Canadian Standard Freeness are shown. In addition, a total current drawn by all refiners is given, plus a composite Canadian Standard Freeness, the latter being determined on a blend of stock from all secondary refiners, diluting to test consistency with recycled water.

TABLE 2

| | | Time A | | | Time B | | |
|---|---|---|---|---|---|---|---|
| Refiner No. | Refiner Type | Refiner Current (amps) | Refining Consistency (%) | Canadian Standard Freeness | Refiner Current (amps) | Refining Consistency | Canadian Standard Freeness |
| 1 | primary | 214 | | | 181 | | |
| 2 | primary | 222 | | | 196 | | |
| 3 | primary | 190 | | | 192 | | |
| 4 | secondary | 200 | 10.3 | 520 | 206 | 10.5 | 438 |
| 5 | secondary | 212 | 5.5 | 520 | 234 | 12.5 | 619 |
| 6 | secondary | 210 | 9.8 | 650 | 203 | 14.0 | 287 |
| 7 | secondary | 190 | 9.0 | 620 | 196 | 10.0 | 201 |
| Total | | 1438 amps | | | 1408 amps | | |
| Composite | | | | 261* | | | 250** |

*Recycled water dilution to 0.32 percent.
**Recycled water dilution to 0.31 percent.

As shown in Table 2, the composite Canadian Standary Freeness dropped to the low end of the target range while the total amperage drawn dropped also.

In both of Examples I and II above, the pulp produced when pulped with sodium aluminate additive was found to have no loss of bursting strength nor brightness.

The above examples demonstrate that the addition of sodium aluminate to pulp material at a level of five pounds sodium aluminate per dry ton pulp production achieves at least a 10 percent reduction in energy consumption without loss of pulp quality.

EXAMPLE III

In a pulping mill utilizing a continuous single state mechanical pulping system in the refiner mechanical pulping category, and equiped with an electric meter, a test run begun with no alkaline salt of aluminate additive was switched to a run having varying levels of sodium aluminate being added at intervals. The results of the addition of sodium aluminate as shown by the ammeter and watt meter readings are shown below in Table 3. In all instances, the pulp material was pulped to a Canadian Standard Freeness of about 600.

TABLE 3

| Time | Sodium aluminate addition (lb/ton) | Ammeter reading (amps) | Watt meter reading (kilowatt-hour/min.) |
|---|---|---|---|
| 8:20 am | none | 250–270 | 60 |
| 8:40 am | none | 270–280 | 64 |
| 8:50 am | none | 260 | 62 |
| 9:20 am | 0.5 | 240 | 50 |
| 9:50 am | 0.5 | 300 | 65 |
| 10:00 am | 0.5 | 300 | 67 |
| 10:20 am | 1.0 | 260 | 56 |
| 10:50 am | 1.0 | 250 | 52 |
| 11:00 am | 1.0 | 260 | — |
| 11:25 am | none | 300 | 65 |
| 11:35 am | none | 320 | — |
| 1:20 pm | 2.0 | 250 | — |
| 1:30 pm | 2.0 | 220 | 50 |
| 2:10 pm | 3.0 | 200–210 | 39 |
| 2:35 pm | 3.0 | 220 | 43 |
| 2:45 pm | 3.0 | 230 | 45 |
| 2:55 pm | 3.0 | 210 | 40 |
| 3:20 pm | none | 270 | — |
| 3:30 pm | none | 300 | 64 |

As the data in Table 3 above demonstrates, a noticeable reduction of energy consumption is begun to be seen at a level of one pound alkaline salt of aluminate per dry ton of end product pulp production, and is extremely significant at a level of three pounds alkaline salt of aluminate level, same basis. At this three pound level, reduction in energy consumption can be summarized as shown below in Table 4.

TABLE 4

| | Untreated | 3 lb/ton |
|---|---|---|
| Ammeter reading | 300 amps | 210 amps |
| % Reduction current | — | 30% |
| Electric meter reading | 64 kw-hr/min. | 41.3 kw-hr/min. |
| % Reduction energy | — | 35% |

The economics of energy consumption reduction can be summarized as shown in Table 5 below.

TABLE 5

Based on voltage of 4160; production rate of 3.1 tons/hr; and electric cost of $0.037/kw-hr.

| | Untreated | 3 lb/ton |
|---|---|---|
| Average amp. reading | 300 | 210 |
| Amps × 4160 volts × .001 | 1,248 kw | 873.6 kw |
| Requirement for 3.1 ton | 1,248 kw-hr | 873.6 kw-hr |
| Cost per ton | $14.89 | $10.42 |

At a level of three pounds sodium aluminate per dry ton of pulp production, the wet pulp material pH was 7.8, below the preferred maximum of pH 8.5. (Without sodium aluminate additive, the wet pulp material pH was in the range of 5.9 to 6.2.)

By "pounds" as used herein is meant avoirdupois pounds, there being 2240 pounds in a ton. Thus the levels of alkaline salt of aluminate can be converted to parts per hundred parts as follows:

| Pounds alkaline salt of aluminate per dry ton pulp production | Parts alkaline salt of aluminate per dry 100 parts pulp production |
|---|---|
| 1 | 0.045 |
| 2 | 0.090 |
| 5 | 0.225 |
| 6 | 0.270 |
| 7 | 0.325 |

INDUSTRIAL APPLICATION OF THE INVENTION

The present invention is applicable to the pulping industry, particularly to the mechanical treatment of pulp material during pulping processes.

The above described particular embodiments of the invention, methods of operation, materials utilized, and combination of elements can vary without changing the spirit of the invention, as particularly defined in the following claims.

We claim:

1. A process for mechanically refining pulp, comprising:

adding from about one pound to about seven pounds of alkaline salt of aluminate per dry ton of end product pulp to pulp material to reduce energy consumption during mechanical refining; and mechanically refining said pulp material at a pH of from about 7.5 to about 8.5 in the presence of said alkaline salt of aluminate.

2. The process of claim 1 wherein said alkaline salt of aluminate is sodium aluminate.

3. The process of claim 1 wherein said alkaline salt of aluminate is potassium aluminate.

4. The process of claim 1 wherein said alkaline salt of aluminate is a mixture of alkaline salts of aluminate.

5. The process of claim 1 wherein said alkaline salt of aluminate is added to said pulp material as an aqueous solution containing from about 1.0 percent by weight to about 50.0 percent by weight alkaline salt of aluminate.

6. The process of claim 1 wherein the mechanical refining is a refiner mechanical pulping.

7. The process of claim 1 wherein the mechanical refining is thermo mechanical pulping.

8. The process of claim 1 wherein said alkaline salt of aluminate is added at a level of from about 2 to about 6 pounds of alkaline salt per dry ton pulp production.

9. The process of claim 8 wherein said alkaline salt of aluminate is added at a level of from about 3 to about 5 pounds of alkaline salt of aluminate per dry ton of pulp production.

* * * * *